United States Patent [19]

Kunreuther

[11] Patent Number: 4,611,740

[45] Date of Patent: Sep. 16, 1986

[54] UNIVERSAL NEEDLE ASSEMBLY FOR FASTENER ATTACHERS

[76] Inventor: Steven J. Kunreuther, 285 Central Park W., New York, N.Y. 10024

[21] Appl. No.: 717,895

[22] Filed: Mar. 29, 1985

[51] Int. Cl.[4] ..... B65C 7/00

[52] U.S. Cl. ..... 227/67

[58] Field of Search ..... 227/67, 156, 19; 493/464

[56] References Cited

U.S. PATENT DOCUMENTS

| | | | |
|---|---|---|---|
| Re. 29,819 | 10/1978 | Bone | 227/67 |
| 4,273,279 | 6/1981 | Kunreuther | 227/67 |
| 4,333,596 | 6/1982 | Kunreuther | 227/67 |

*Primary Examiner*—Paul A. Bell

*Attorney, Agent, or Firm*—James & Franklin

[57] ABSTRACT

The planar knife blade extends rearwardly from the hollow base of the needle assembly. The base is designed to be received in the cylindrical opening of the body of a fastener attacher. The end of the opening is partially obstructed by a protruding shoulder. The blade is tangentially aligned with the bore. It extends from a point proximate the side surface of the base through a plane bisecting the base to a point a short distance beyond the plane, so as to accommodate the shoulder. Accordingly, the assembly can be used in fastener attachers either adapted to receive a knifeless needle or a needle with a knife blade mounted within the base.

7 Claims, 33 Drawing Figures

PRIOR ART

5

PRIOR ART

5

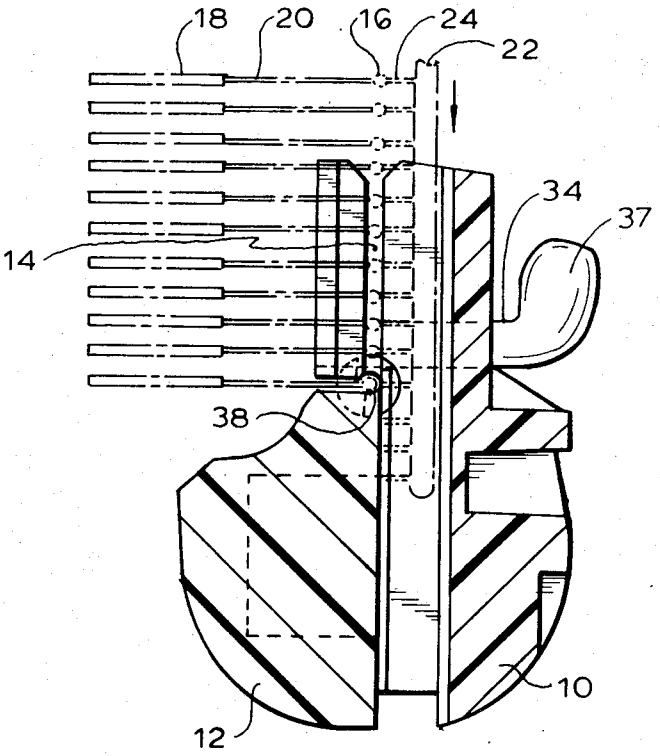
FIG. 12
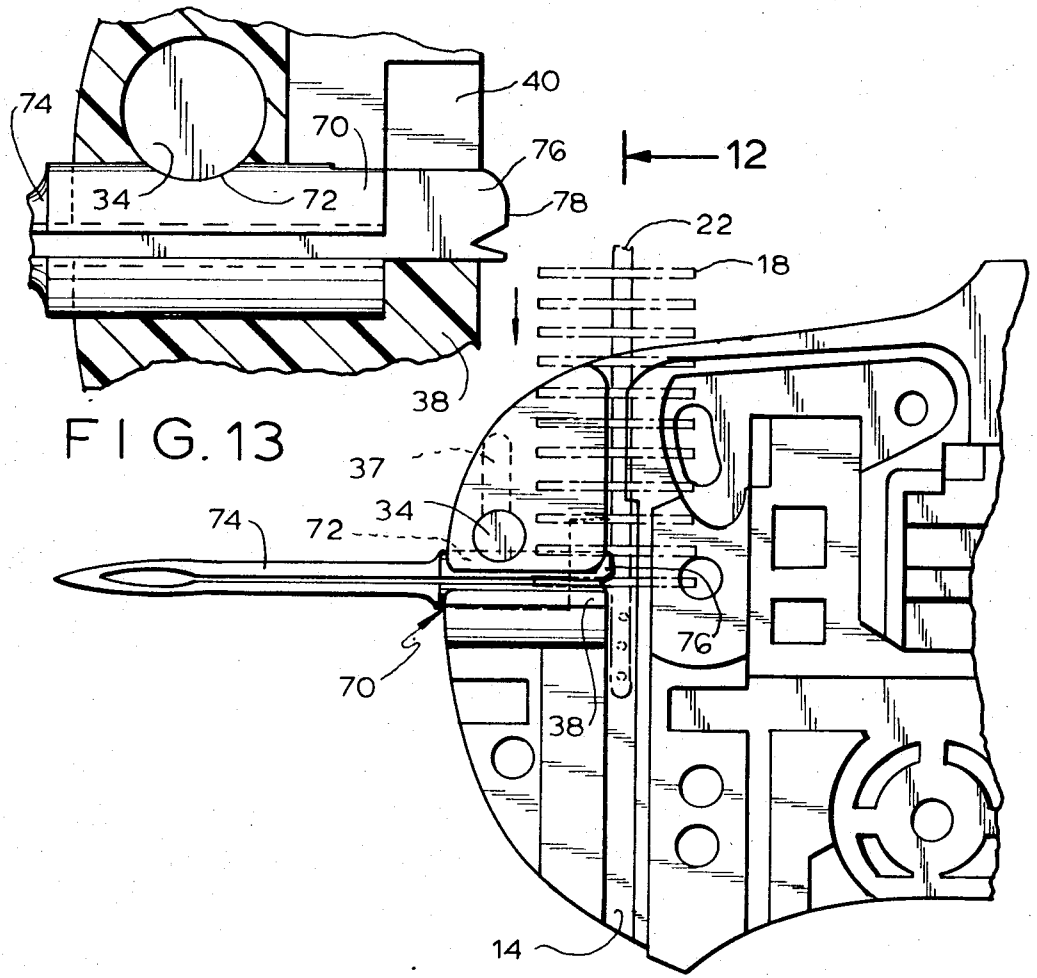
FIG. 13
FIG. 11

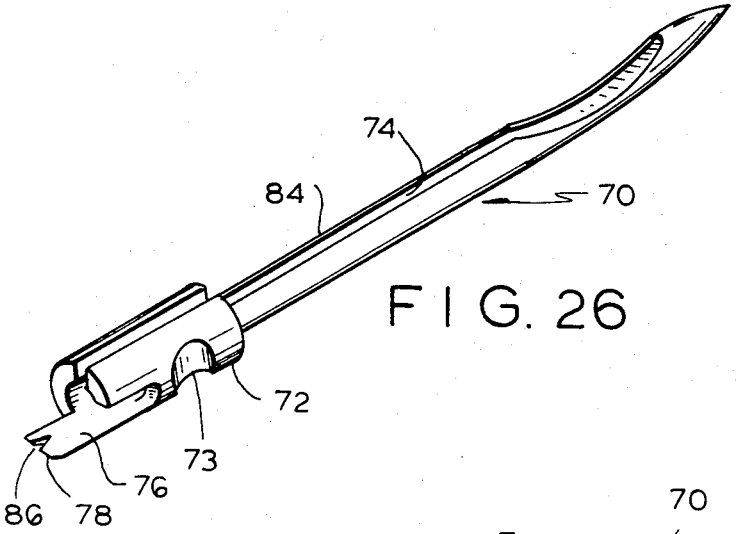
FIG. 26
FIG. 29
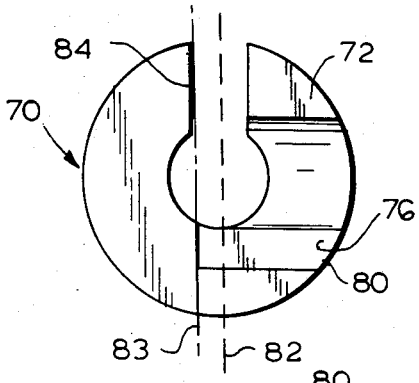
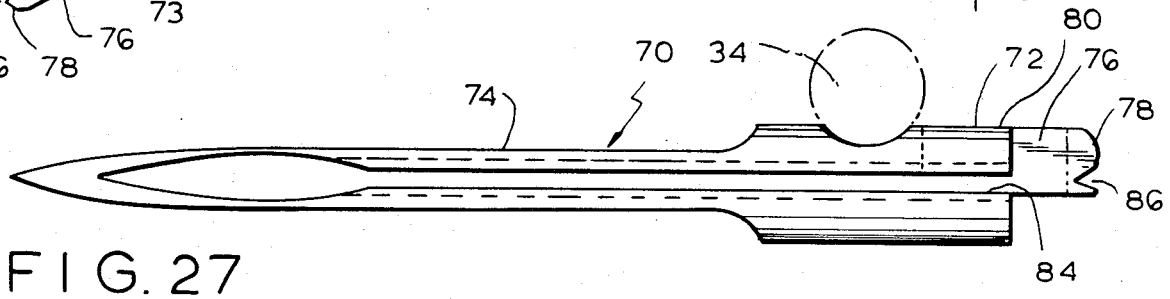
FIG. 27
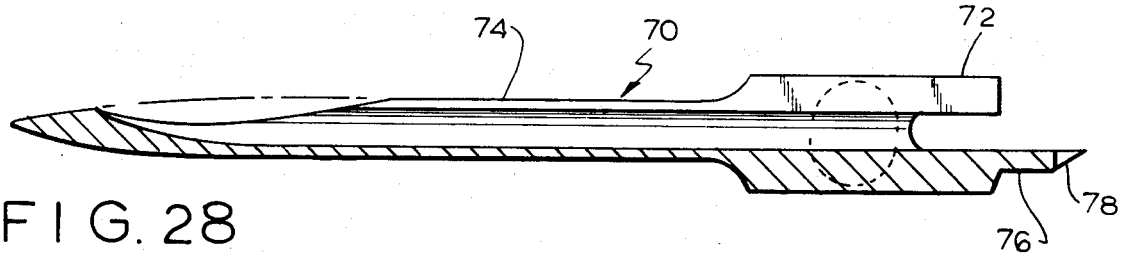
FIG. 28

UNIVERSAL NEEDLE ASSEMBLY FOR FASTENER ATTACHERS

The present invention relates to a novel construction of a needle assembly for use in fastener attaching apparatus and, more particularly, to a needle assembly which can be used in fastener attachers of various structures including those adapted to receive knifeless needles and separate knife blades and those adapted to receive needles with the knife blade mounted within the confines of the base.

Plastic fastener attachments are widely used throughout the wearing apparel and softgoods industries, as well as other industries, in order to attach labels or other items to products in a manner which prevents accidental or unlawful detachment thereof. Attachments of this type are normally made of nylon or similar high strength plastic and typically comprise a relatively thin filament connecting a T-bar shaped end with an enlarged paddle end. Such attachments are commercially available from several different suppliers. Each source supplies attachments in a number of different sizes, colors and styles.

The attachments are sold in clips typically containing fifty or a hundred attachments aligned in side-by-side relationship. The T-bar ends of the attachments of each clip are separately connected to a common runner bar by connecting parts extending between the runner bar and each attachment. The attachments may be unconnected at their paddle ends or may be connected by various techniques to prevent tangling.

The clips of attachments are designed for use in attaching apparatus in the form of manually actuated attachers, commonly referred to as "guns" because of their pistol-like design. The attachments can be used in power actuated apparatus as well. Various types of attachers or guns are known in the art and are commercially available. The attachers or guns comprise a plastic housing body with a cylindrical opening into which a slotted, hollow needle is removably mounted. The clip of attachments is inserted into a slot in the housing which extends behind the needle. Actuation of the attacher trigger causes a plunger, aligned with the T-bar end of the first attachment in the clip, to be displaced forwardly such that the first attachment in the clip is forced through the bore in the needle. As the trigger is released, the next attachment in the clip is automatically aligned with the needle bore. In this way, each attachment, in sequence, is aligned and dispensed.

The T-bar end of each of the attachments in the clip must be severed from the clip as same is dispensed. This is achieved by severing the connecting part between the T-bar end and the runner bar. The attachment is severed from the runner bar by pushing the connecting part against a knife blade or cutting edge located within the attacher housing, either on the needle itself or mounted separately within the body of the attacher.

In order to attach a tag to a garment or the like, the attacher is loaded with a clip of attachments and the needle is caused to penetrate the label and the garment. The attacher trigger is then actuated, such that the T-bar end of the attachment is separated from the runner bar, pushed by the plunger through the needle bore, and situated at the rear of the garment. The needle is then withdrawn, leaving the attachment with the T-bar end on one side of the garment and the label and the paddle end of the attachment, on the other side of the garment, such that the label is securely attached to the garment.

Conventional needle assemblies designed for use in attachers of the type described include a shaft portion which has a relatively sharp tip to permit penetration of the articles to be attached and a substantially cylindrical rear portion. The shaft is hollow to permit the T-bar end of the attachment to pass therethrough and has a longitudinal slot to permit the filament of the attachment to extend therefrom as the T-bar end moves through the needle. The shaft portion extends from a substantially cylindrical base having a central bore with an inner diameter equal to the inner diameter of the hollow shaft. The base also has a longitudinal slot which is aligned with the slot in the shaft to permit the filament to move through the needle assembly. Such needle assemblies are normally removably mountable in the attacher housing to permit replacement in case of damage or wear. The base is usually provided with means for correctly orienting the needle within the attacher and for locking same into place.

Certain attachers are designed to accept needle assemblies wherein the blade for severing the T-bar end from the runner bar is mounted within the confines of the needle base itself. This single part construction has the advantage of simplicity, but requires that the entire needle assembly be replaced when the blade becomes dull because resharpening of the blade is not possible.

Other attachers utilize a knifeless needle assembly and a knife blade which is separate from the needle assembly. The blade is removably mounted in the housing in alignment with the rear of the needle assembly receiving opening.

In both types of attachers, a shoulder, which protrudes from the attacher body, partially defines the end of the needle receiving opening and is located to abut the rear of the needle base. The shoulder functions to position the needle by limiting the inward movement of the needle in the attacher body. However, the base of the knifeless needle is shorter than the needle with the blade contained therein. Consequently, the shoulder must be located at different positions in each type of attacher. As a result, neither type of standard needle assembly can fit both types of attacher.

It is highly desirable that the T-bar end of the attachment be severed from the runner bar as cleanly as is possible. As little as possible of the connecting part between the T-bar end and the runner bar should remain on the T-bar after it is separated. This is because any residue of the connecting part which protrudes from the surface of the T-bar can snag and/or tear delicate fabrics.

In order to insure that the T-bar of the attachment is severed from the runner bar without leaving any substantial portion of the connecting part, the blade must be situated tangential to the bore in the base of the needle. This is relatively easily accomplished because the knife blade is mounted within the needle base. However, in attachers with separate knife blades, it is necessary to utilize the protruding shoulder to properly position and stabilize the blade and, even with this structure, alignment is often imperfect.

In U.S. Pat. Nos. 4,273,279 and 4,333,596, both of which are entitled "High Strength Needle Assembly With Sharpenable Cutting Edge", I have described a unique needle assembly including a knife part with a cutting edge which is accessible for re-sharpening. In general, the assembly includes a shank or shaft part with a cylindrical hollow portion, a slotted base having a central bore, and a knife part. The central bore of the base has first and second sections. The first section has an inner diameter equal to the outer diameter of the cylindrical portion such that the shank can be inserted therein and secured thereto by an adhesive. The second section has an inner diameter equal to the inner diameter of the cylindrical portion. The knife part includes a body portion with a cutting edge at one end and a protrusion on the other end. The protrusion is adapted to be received within and secured to a recess adjacent the second section of the bore. The knife part extends beyond the base in a direction substantially parallel to the axis of the base such that the cutting edge is accessible for resharpening.

The needle assembly described in the above-identified patents functions well in attachers of the type adapted to accept needles with blades mounted within the base because, although the base is the same length as the base of the knifeless needle, the overall length of the base, including the extending knife, is equal to the length of the base of the needle with the blade mounted therein. However, such needle assemblies cannot function properly when inserted into an attacher designed to accept a knifeless blade because the shoulder partially obstructing the rear of the needle receiving opening interferes with the rearwardly extending knife part displacing same from its normal position tangential to the base bore. Thus, the T-bar of the attachment either cannot be severed from the runner bar or is severed in a way which leaves a substantial portion of the connecting part between the T-bar and the runner bar in tact to snag and tear delicate fabrics.

It is, therefore, a prime object of the present invention to provide a needle assembly with a rearwardly extending knife which will function reliably in the attachers designed to accept knifeless needles and attachers designed to accept needles with blades mounted within the base.

It is another object of the present invention to provide a needle assembly with a rearwardly extending knife part which will insure clean separation of the T-bar end of the attachment from the runner bar without leaving any substantial connecting part residue.

In accordance with one aspect of the present invention, a needle assembly is provided for use in fastener dispensing apparatus. The assembly comprises a substantially cylindrical base having a side surface, a central bore, and a slot defined by an edge. The plane bisecting the base passes through the slot. A shaft part extends from one end of the base. A knife part extends from and beyond the other end of the base. The knife part comprises a substantially planar body part situated substantially tangentially to the bore. The body part extends from a point proximate to the side surface of the base, through the bisecting plane, to a point substantially aligned with the edge of the slot.

In accordance with another aspect of the present invention, a needle assembly is provided for use in fastener attaching apparatus of the type having a housing. The housing includes a needle assembly receiving opening and a shoulder protruding into alignment with and partially obstructing the end of the opening. The needle assembly comprises a substantially cylindrical base adapted to be received in the opening. The base has a side surface, a central bore, and a slot defined by an edge. The plane bisecting the base passes through the slot. A needle part extends from the end of the base. A knife part extends from and beyond the other end of the base. The knife part comprises a substantially planar body situated substantially tangentially to the bore. The body extends from a point proximate to the side surface of the base, through the plane, to a point a small distance beyond the plane. Preferably, the small distance is approximately equal to the distance between the plane and a parallel plane which passes through the edge of the base slot. This permits the body part to be received proximate the shoulder.

In accordance with another aspect of the present invention, a fastener attaching apparatus is provided. The apparatus comprises a housing including a needle assembly receiving opening. A protruding shoulder partially obstructs one end of the opening. A needle assembly is provided comprising a substantially cylindrical base adapted to be received within the opening. The base has a central bore and a slot. The plane bisecting the base passes through the slot. A shaft part extends from one end of the base. A knife part extends from and beyond the other end of the base. The knife part comprises a substantially planar body part situated substantially tangentially to the bore. The knife part extends from a point proximate the side surface of the base, through the bisecting plane, to a point a short distance from the plane. The short distance is preferably approximately equal to the distance betwen the bisecting plane and a parallel plane which intersects the edge of the slot. This permits the body part to be received proximate the shoulder.

Preferably, the body part comprises a cutting blade. The cutting blade is situated on the end of the body part, spaced from the bore. The cutting blade may include a "V"-shaped notch aligned with the bisecting plane.

To these and to such other which may hereinafter appear, the present invention relates to a universal needle assembly as described in detail in the following specification and recited in the annexed claims, taken together with the accompanying drawings, wherein like numerals refer to like parts, and in which:

FIG. 11 is a side cross-sectional view of the front of the attaching apparatus illustrated in FIG. 1, showing the needle assembly of the present invention mounted therein;

FIG. 12 is a cross-sectional view of the apparatus illustrated in FIG. 11, taken along line 12—12 of FIG. 11;

FIG. 13 is an enlarged fragmentary view of the needle receiving portion of the tag attaching apparatus shown in FIG. 11 with the needle of the present invention mounted therein;

FIG. 26 is an isometric view of the needle assembly of the present invention;

FIG. 27 is a side view of the needle assembly of the present invention;

FIG. 28 is a top view of the needle assembly of the present invention;

FIG. 29 is a rear end view of the needle assembly of the present invention;

Figure 2:
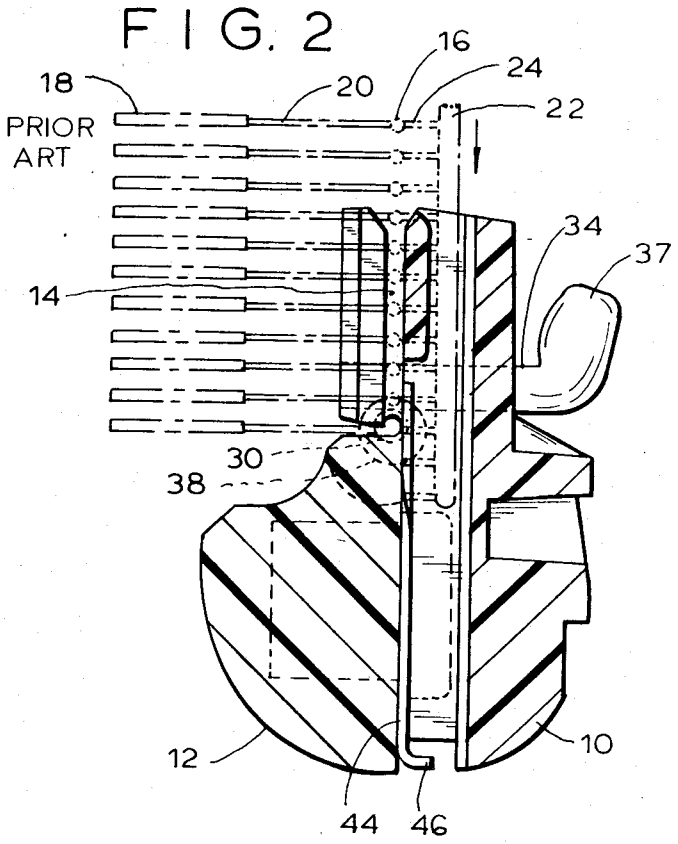
FIG. 2 is a cross-sectional view taken along line 2—2 of FIG. 1.

FIGS. 1–13 illustrate the front portion of a tag attaching apparatus which is designed to accept a knifeless needle and a separately mounted knife blade. The tag attaching apparatus, generally designated A, includes a plastic body formed of two halves 10 and 12 which are joined together by means of screws or the like. The halves 10, 12, when assembled, define a vertical channel 14 into which a clip of tag attachments can be inserted. The tag attachments each include a T-bar end 16, an enlarged paddle end 18, and a thin filament 20 connecting same. Each attachment is connected to a common runner bar 22 by means of a connecting part 24.

The attachments are pushed through channel 14 until the first attachment in the clip is aligned with the needle receiving portion, generally designated B, of attacher A. As best seen in FIGS. 3–6, the needle receiving portion B of body A comprises a generally cylindrical opening 26 which extends from the front surface of body A towards channel 14. Opening 26 is designed to receive the hollow slotted base 28 of a standard knifeless needle 30. Needle 30 also includes a slotted shank 32 extending from the front end of base 28.

The exterior surface of base 28 is provided with a recess into which a needle locking shaft 34, rotatably mounted within a needle lock shaft opening 36, is situated. Shaft 34 extends in a direction perpendicular to channel 14. Needle locking shaft 34 is connected to an external lever 37 which permits manual rotation of the shaft from a first position wherein a portion of the shaft is situated in the indentation on base 28 to lock same into body A, and a second position wherein an indentation in the shaft aligns with base 28 such that the needle can be removed by pulling same forwardly with respect to body A.

The rear of needle receiving opening 26 is partially defined by a shoulder 38 which protrudes into alignment with the end of the needle receiving opening from body A. The edge of shoulder 38 is spaced from a wall 40 situated between the end of the needle receiving opening and channel 14 and which partially defines channel 14. The space between shoulder 38 and wall 40 forms a portion of a channel 42 into which a cutting blade 44 is adapted to be separately mounted. The blade 44 has a part which is received between shoulder 38 and part 40 which function to stabilize same. At the extreme lower end, the blade 44 has a bent part 46 to facilitate removal thereof from channel 42.

Figure 3:
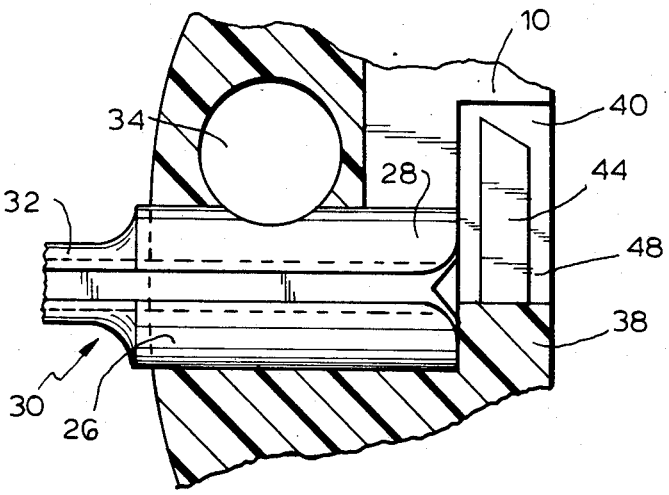
FIG. 3 PRIOR ART
FIG. 3 is an enlarged fragmentary view of the needle receiving portion of the attacher illustrated in FIG. 1.
Figure 6:
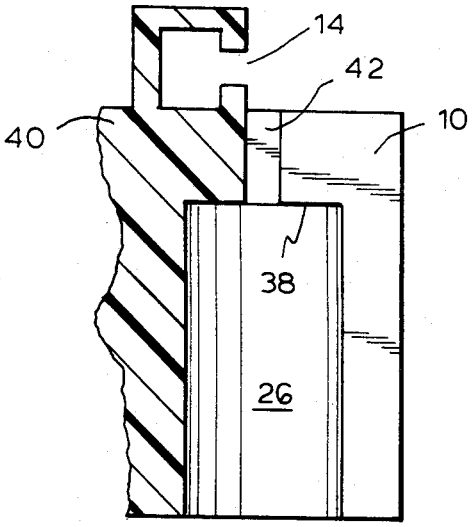
FIG. 6 is a top fragmentary view taken along line 6—6 of FIG. 5.
Figure 4:
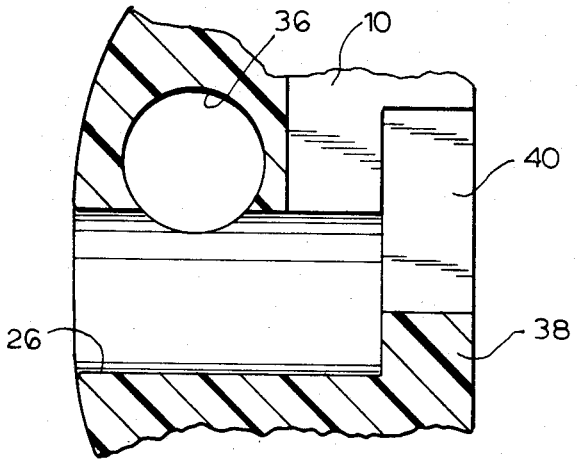
FIG. 4 PRIOR ART
FIG. 4 is a view identical to FIG. 3, but without the needle and needle lock cylinder present therein.
Figure 5:
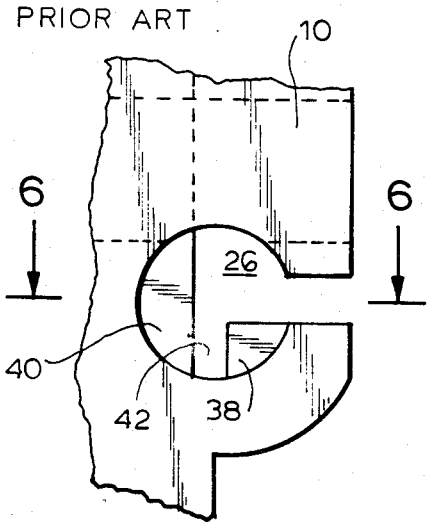
FIG. 5 is a front fragmentary view of the needle receiving portion of the attacher taken along line 5—5 of FIG. 4.
Figure 8:
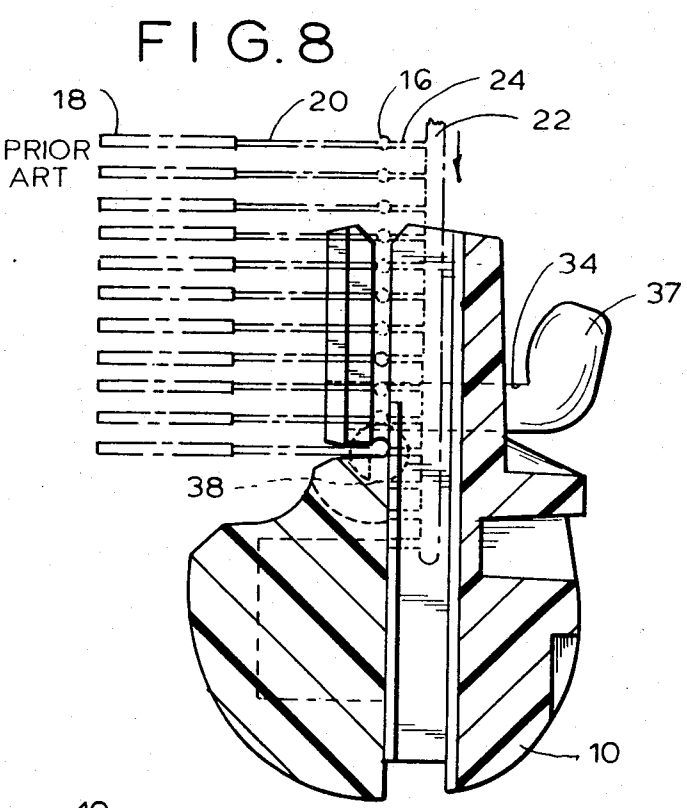
FIG. 8 is a cross-sectional view of the attaching apparatus taken along line 8—8 of FIG. 7.

When blade 44 is mounted within channel 42, as illustrated in FIG. 3, the cutting edge 48 thereof is aligned with, but behind, the bore of needle 30 such that when the plunger (not shown) moves forwardly and engages the T-bar 16 of an attachment, the forward movement of the T-bar will cause the blade 48 to sever connecting part 24 between the T-bar end 16 and runner bar 22 and, thereafter, dispense the attachment. In this configuration, needle 30 has no knife blade and the rear end thereof directly abuts the surface of shoulder 38 and wall 40.

As illustrated in FIGS. 7 through 10, my patented needle 50 (as disclosed in U.S. Pat. Nos. 4,273,279 and 4,333,596) has a base portion 52 and a shank portion 54 which are identical to the corresponding portions of the knifeless needle 30. However, it has a rearwardly extending planar blade portion 56 situated tangential to the central bore of the base 52 and extending across the end thereof from one point on the side surface of the base to the other. The rear portion of blade 56 has a cutting edge 58 which may include a notch 60, if desired.

Figure 10:
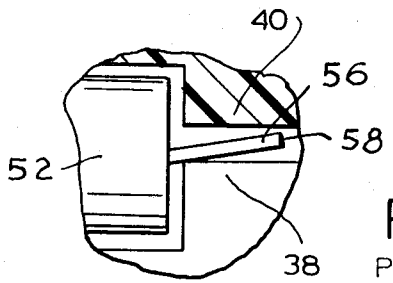
FIG. 10 PRIOR ART
FIG. 10 is a top fragmentary view of the needle receiving portion of the attacher with my patented needle taken along line 10—10 of FIG. 9.
Figure 7:
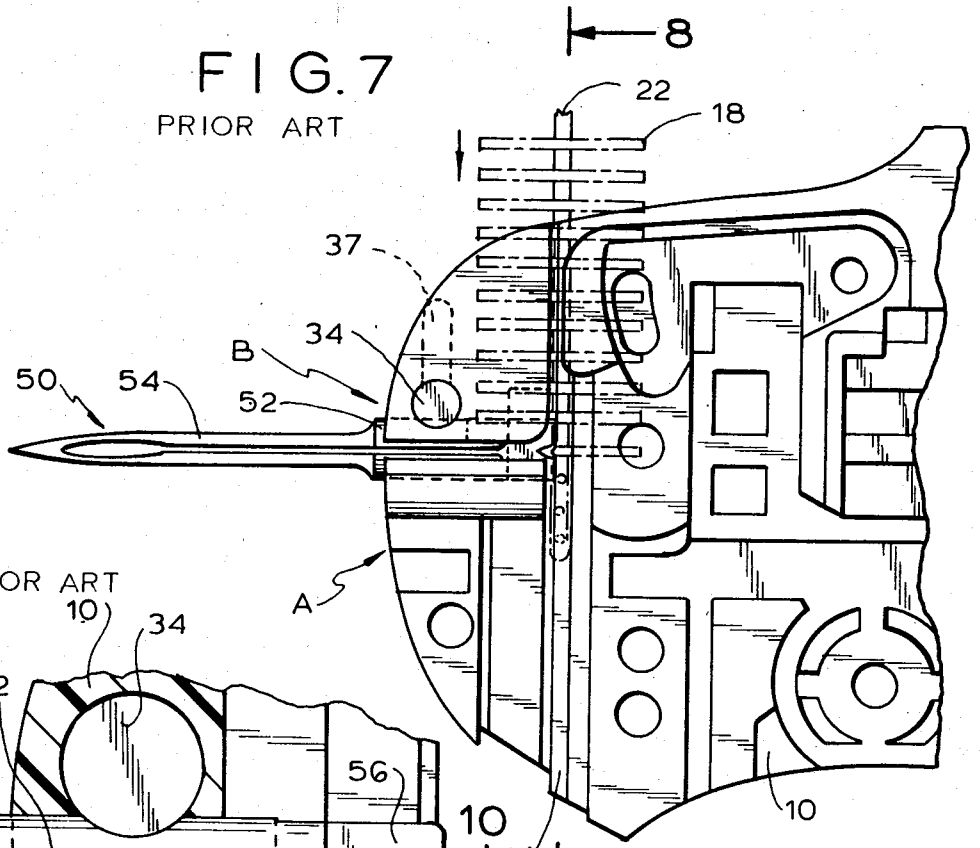
FIG. 7 PRIOR ART
FIG. 7 is a side cross-sectional view similar to that shown in FIG. 1, but with the knifeless needle and separate cutting blade replaced with my patented needle.
Figure 9:
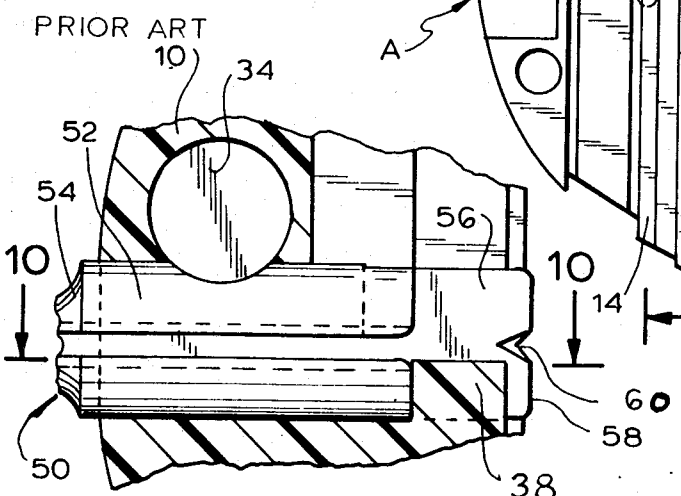
FIG. 9 is a fragmentary cross-sectional view of the needle receiving portion of the attacher illustrated in FIG. 7, showing my patented needle mounted therein.
Figure 15:
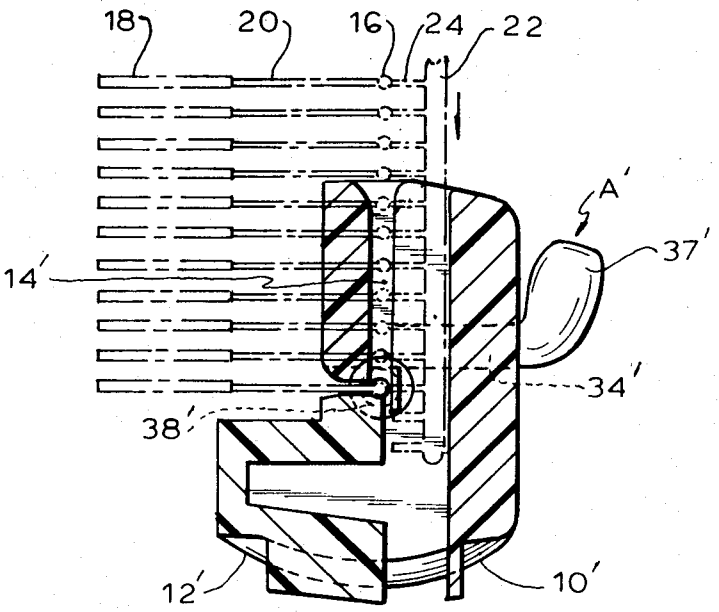
FIG. 15 PRIOR ART
FIG. 15 is a cross-sectional view of the tag attaching apparatus of FIG. 14, taken along line 15—15 of FIG. 14.

Since the rearwardly extending blade portion 56 extends from one point on the side surface of the base 52 of needle 50 to the other, it is not usable in an attacher of the type illustrated in FIGS. 1–13, as illustrated in FIG. 10. This is because shoulder 38 is situated in the area in which knife blade 56 would normally occupy. Thus, if my patented needle were to be forced into the apparatus, as shown in FIGS. 9 and 10, either shoulder 38 or blade 56 would break or, alternatively, blade 56 would be cammed outwardly from its normal position, as shown in FIG. 10, such that it no longer lies in a plane tangential to the bore of the needle. If blade 56 is not tangential to the bore of the needle, connecting part 24 will not be properly severed and a portion of the connecting part will remain on the T-bar 16, resulting in the snagging and tearing of delicate fabrics.

Accordingly, my patented needle cannot be used in the type of tag attacher illustrated in FIGS. 1–13, even when the removable cutting blade 44, of the type normally used in this type of apparatus, is not present. Further, a needle containing a knife blade within the confines of the base itself, as described below, also cannot fit into this type of apparatus because the base thereof is too long to permit the needle to be properly positioned within the needle receiving opening. Accordingly, until now, the only type of needle which could be used in the tag attaching apparatus of the type shown in FIGS. 1–13 was a conventional knifeless needle which had to be used in conjunction with a separate removably mounted knife blade.

FIGS. 25–28 illustrate the structure of the needle assembly 70 of the present invention. The needle includes a hollow slotted base 72 having a recess on the surface thereof for accommodating the needle locking shaft 34. From the forward end of base 72 extends a slotted shank part 74 of conventional design. Extending rearwardly from the rear end of base 72 is a substantially planar knife part 76 having a cutting edge 78. As best seen in FIG. 27, knife part 76 extends from one point on side surface 80 of base 72 through a plane 82 (see FIG. 29) which bisects the needle passing through the central axis thereof and the middle of the slot in base 72, to a plane 83 which is parallel to plane 82, but which passes through edge 84 which defines one side of the slot. In other words, the width of blade 76 is not equal to the width of base 72 at a point tangential to the bore, but is substantially shorter and extends only partially across the width of the needle base at this point.

Preferably, a "V"-shaped notch 86 is provided in the cutting edge 78, in alignment with the plane 82. Notch 86 centers the connecting part 24 on the blade during severing.

Figure 1:
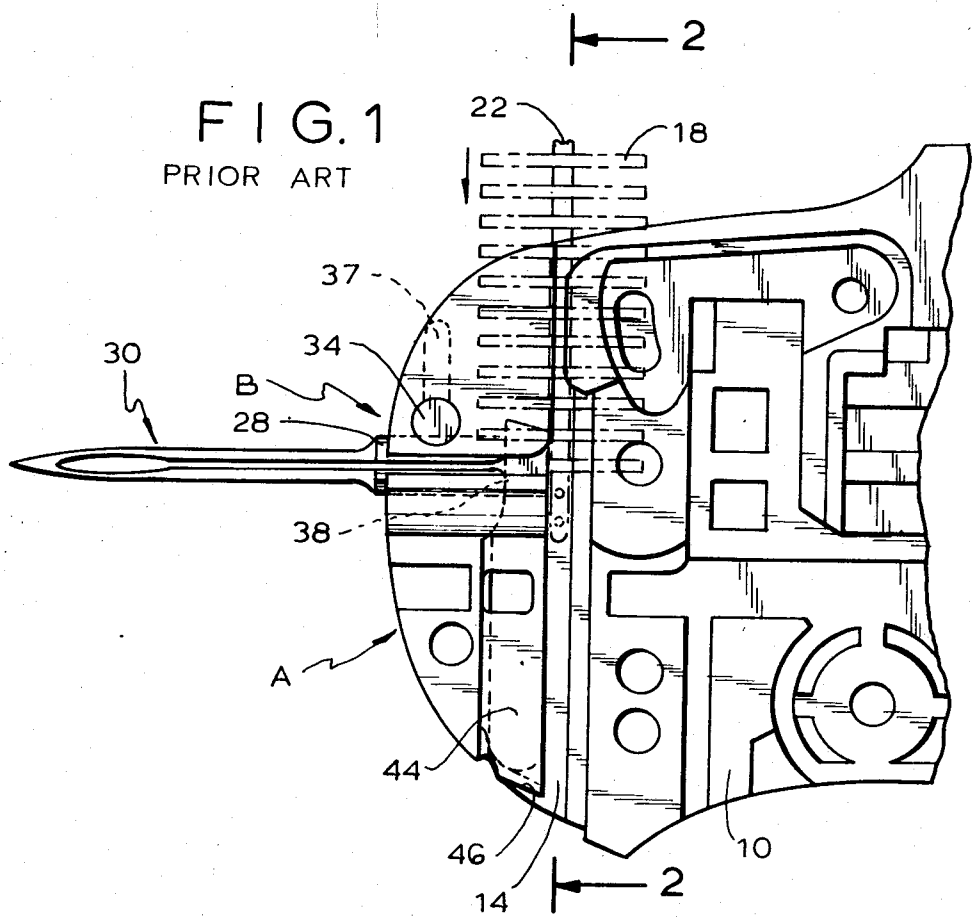
FIG. 1 PRIOR ART
FIG. 1 is a side cross-sectional view of the front portion of a first type of tag attaching apparatus having a knifeless needle and a separately mounted cutting blade mounted therein.

The reason for the configuration of the present invention can best be appreciated from FIGS. 11–13 which show the needle of the present invention mounted in the tag attaching apparatus of the type illustrated in FIG. 1. As seen in FIG. 13, the base 72 of needle 70 has essentially the same size and shape as that of needle 30, except that blade 76 extends rearwardly to a position adjacent wall 40, but above shoulder 38. In other words, the shape of blade 76 is designed so as to accommodate shoulder 38 without being skewed or displaced from a plane tangential to the bore of the base.

Accordingly, the needle of the present invention fits excellently within the structure of this type of tag attaching apparatus and, hence, can be used as a replacement for the conventional knifeless needle and the separate removably mounted knife blade normally used in conjunction therewith. In addition, the needle of the present invention fits equally well in a tag attaching apparatus of the type designed to accept a needle with a knife blade situated within the confines of its base, as described below.

FIGS. 14–25 illustrate a tag attaching apparatus designed to accept a needle with a knife blade which is mounted within the confines of the base thereof. This type of attacher also has a body generally designated A′ comprising parts 10′ and 12′. The clip of fasteners is received within a channel 14′ which extends through body A′ along the rear end of needle receiving portion B′ of body A′.

As best seen in FIGS. 16–19, the needle receiving portion B′ includes a cylindrical needle receiving opening 26′ adjacent to which is situated a needle locking shaft 34′ in a bore 36′ extending in a direction substantially perpendicular to channel 14′.

Figure 14:
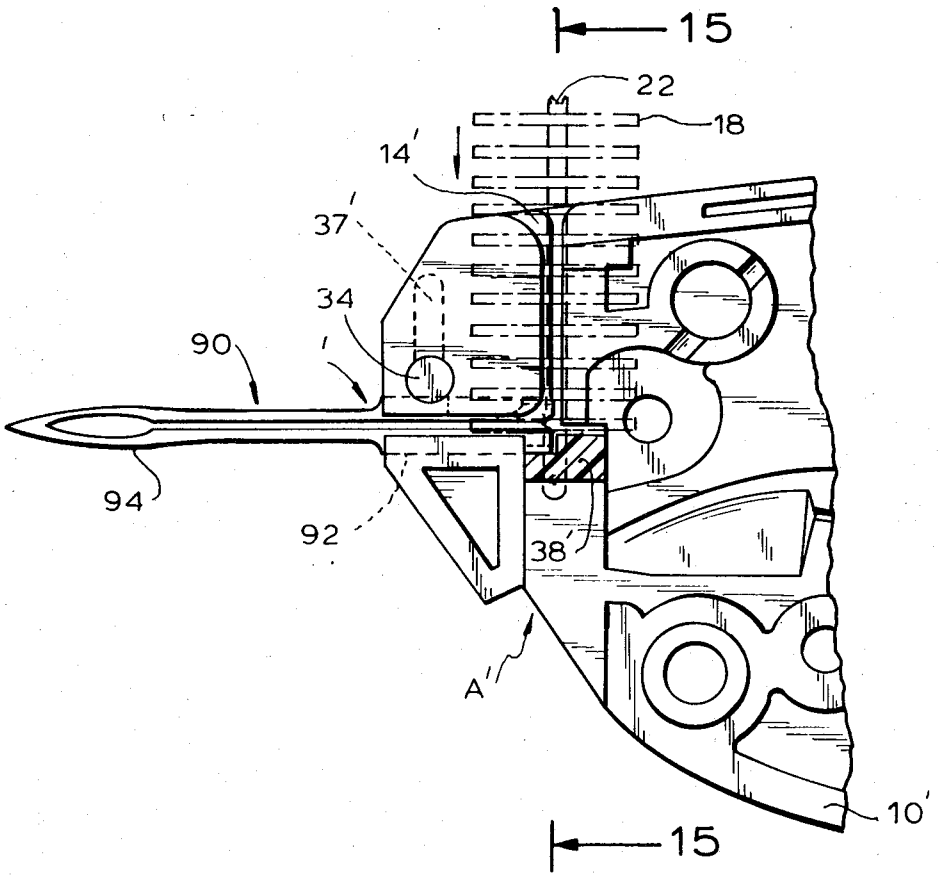
FIG. 14 PRIOR ART
FIG. 14 is a side cross-sectional view of the front portion of a second type of tag attaching apparatus designed to accept a needle with a knife blade mounted within the confines of the base thereof.

This type of apparatus, like the apparatus illustrated in FIGS. 1–13, has a shoulder 38′. This shoulder partially defines the rear of needle receiving opening 26′. It is against shoulder 3′ which the rear of the needle assembly abuts when the needle assembly is properly positioned within needle receiving opening 26′, as illustrated in FIG. 14.

The tag attaching apparatus of this type is designed to receive a needle assembly 90 which includes a generally cylindrical hollow slotted base 92 and a forwardly extending shaft part 94. Base 92 is a plastic part which surrounds a steel knife part 96 and has a rear cutting edge 98 confined within the base. Preferably, steel part 96 is integral with steel shank 94. The needle may be formed by injection molding the plastic base part 92 around the knife part 96.

Figure 16:
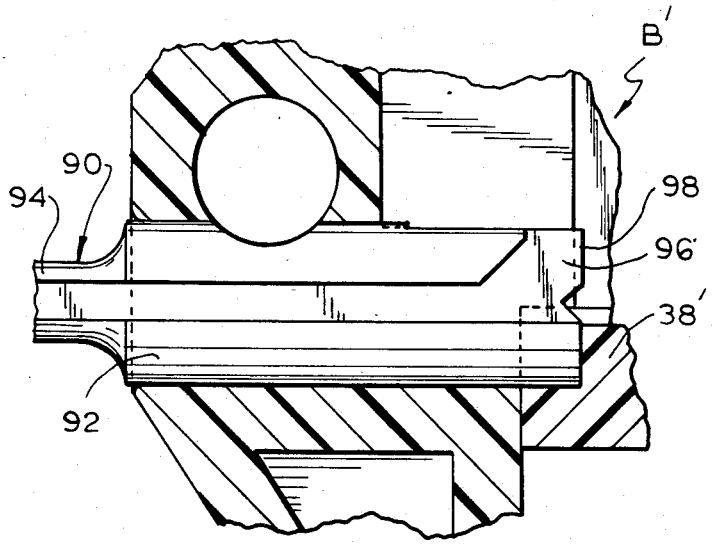
FIG. 16 PRIOR ART
FIG. 16 is an enlarged fragmentary view of a portion of the tag attaching apparatus illustrated in FIG. 14 showing a needle assembly having a knife blade mounted within the confines of the base thereof.
Figure 19:
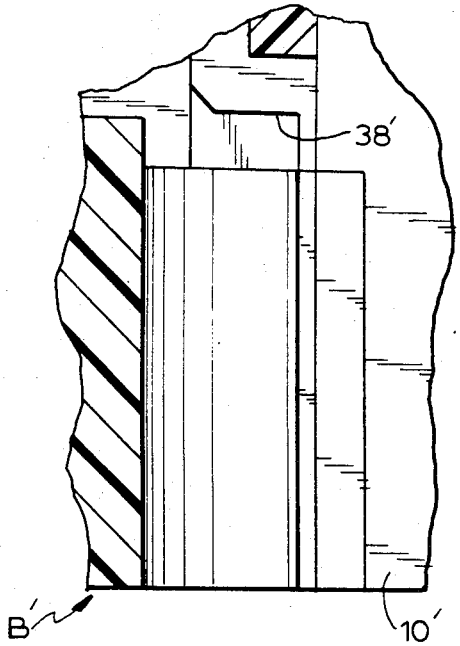
FIG. 19 PRIOR ART
FIG. 19 is a top view taken along line 19—19 of FIG. 18.
Figure 17:
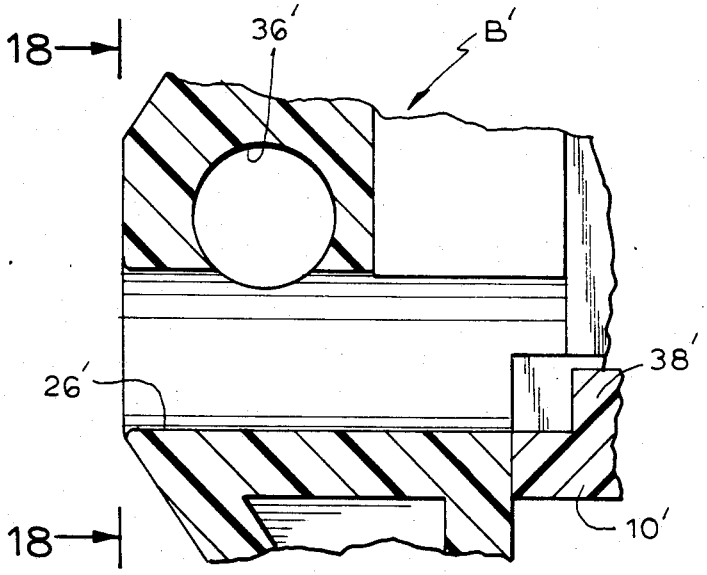
FIG. 17 PRIOR ART
FIG. 17 is a view similar to FIG. 16, but without the needle and lock cylinder mounted therein.
Figure 18:
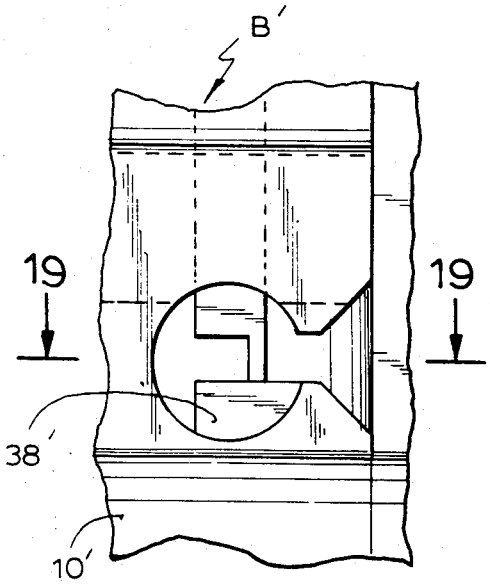
FIG. 18 PRIOR ART
FIG. 18 is a front fragmentary view of the needle receiving portion of the tag attaching apparatus taken along line 17—17 of FIG. 17.

As can best be seen by a comparison of FIGS. 3, 9, and 16, the base 26 of knifeless needle 30 and the base 52 of the patented needle 50 have substantially the same length, whereas the length of base 92 of the needle 90 with the knife blade mounted within the confines of the base is substantially longer than the other two. Accordingly, needle 90 clearly cannot be received within the needle receiving opening 26 of the tag attaching apparatus illustrated in FIGS. 1–13. This is because shoulder 38 is situated therein in a position which will prevent a needle of the type of needle 90 from being fully received within needle receiving opening 26. On the other hand, shoulder 38′ in body A′, as shown in FIGS. 14–25, is situated at a position to permit the full length of base 92 to be mounted within body A′.

Figure 21:
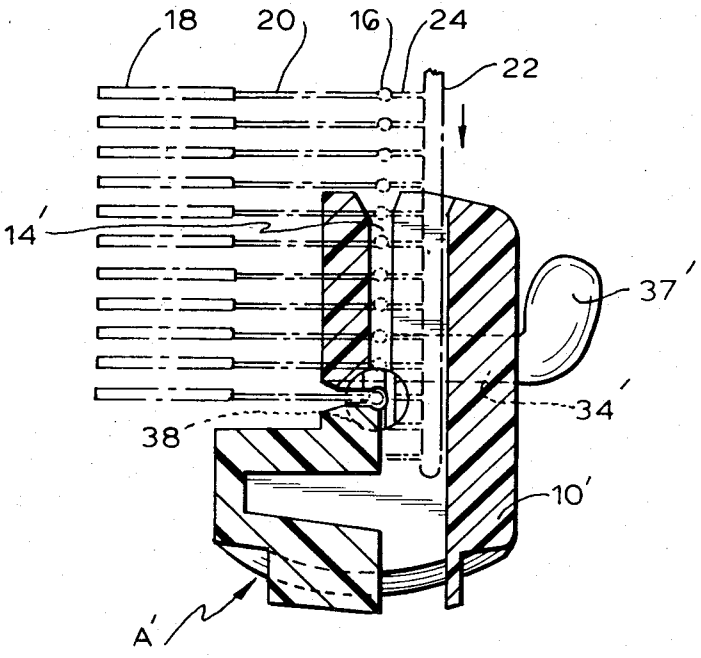
FIG. 21 PRIOR ART
FIG. 21 is a cross-sectional view taken along line 21—21 of FIG. 20.
Figure 20:
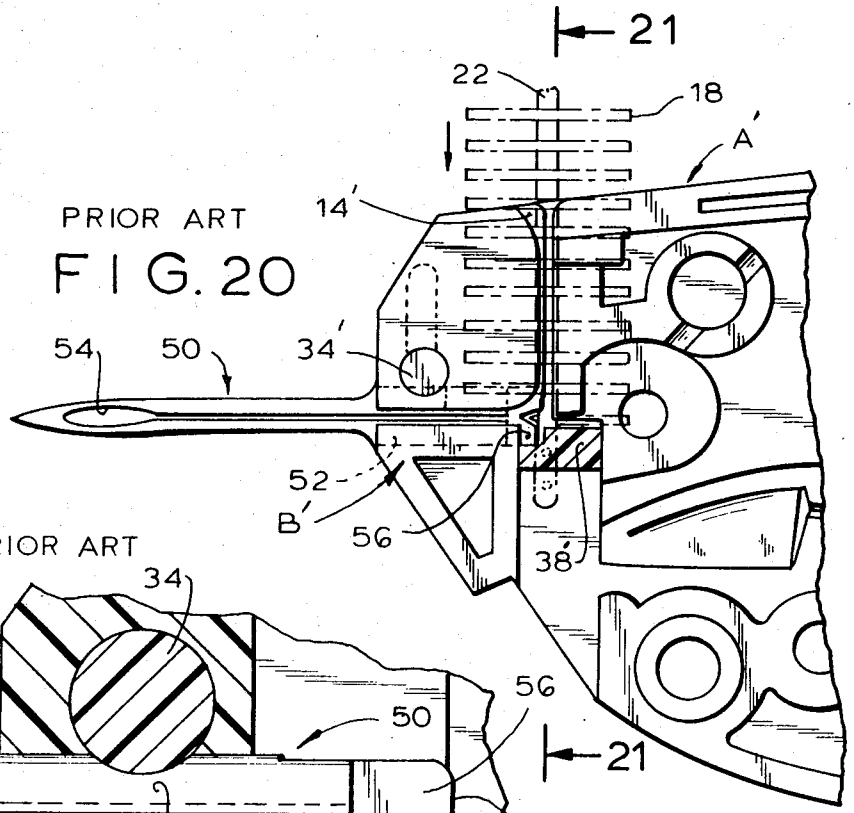
PRIOR ART FIG. 20
FIG. 20 is a side cross-sectional view of the front of the tag attaching apparatus of the type shown in FIG. 14 with my patented needle therein.
Figure 22:
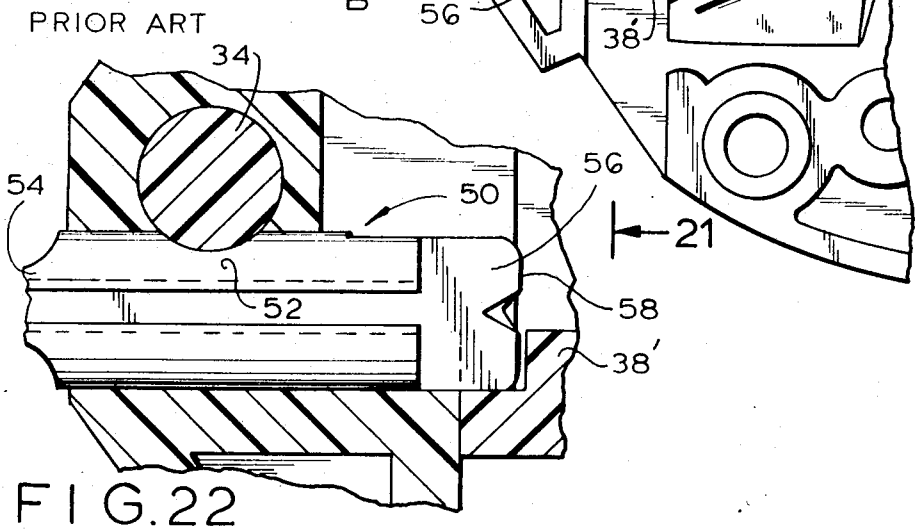
PRIOR ART FIG. 22
FIG. 22 is an enlarged fragmentary view of the needle receiving portion of the tag attaching apparatus illustrated in FIG. 20, showing my patented needle therein.

FIGS. 20–21 illustrate how my patented needle can be received within needle receiving opening 26′ in tag attaching apparatus A′. In particular, FIG. 22 shows that shoulder 38′ in body A′ does not interfere with the rearwardly extending cutting blade 56 of patented needle 50. Thus, patented needle 50 can be correctly positioned within needle receiving opening 26′.

Figure 24:
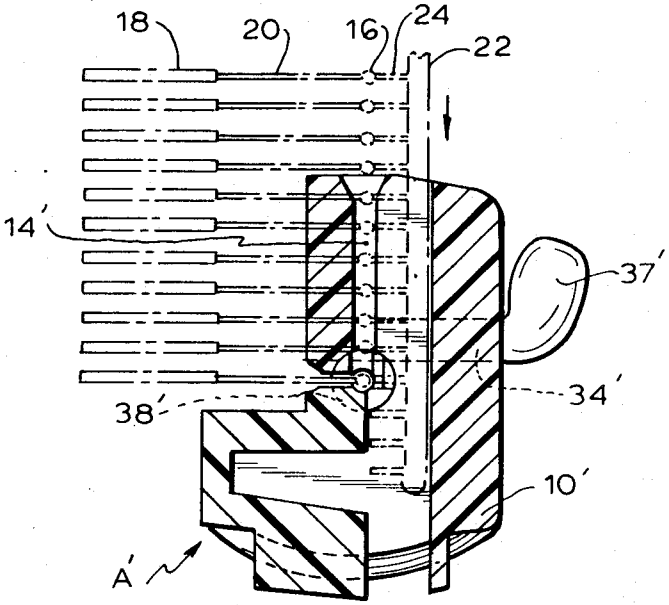
FIG. 24 is a cross-sectional view taken along line 24—24 of FIG. 23.
Figure 23:
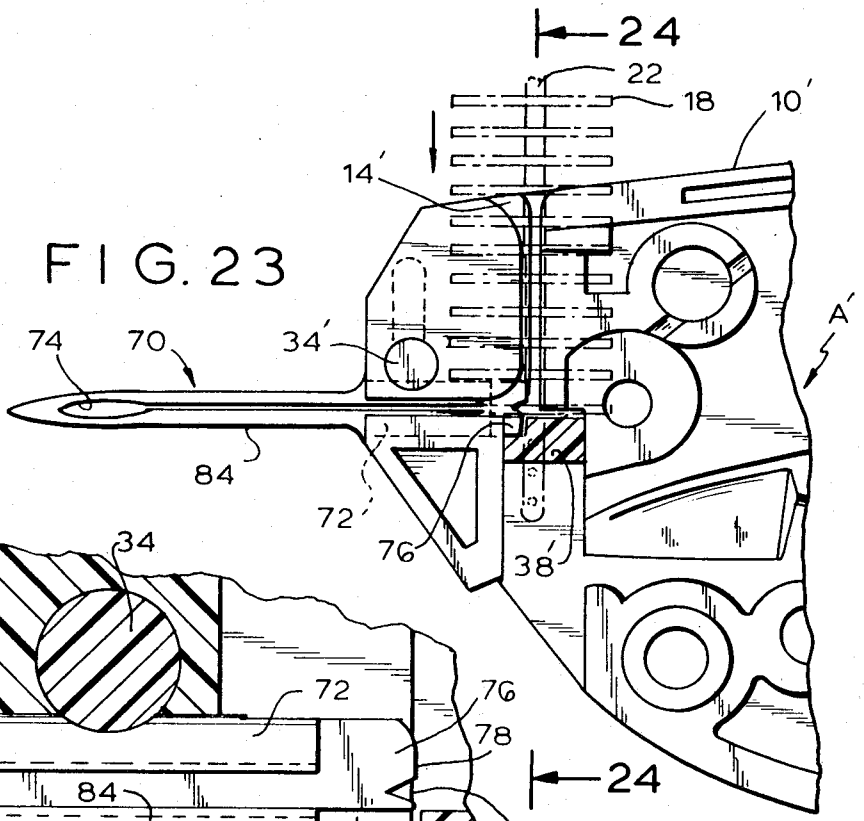
FIG. 23 is a side cross-sectional view of the portion of a tag attaching apparatus of the type shown in FIG. 14 with the needle of the present invention therein.
Figure 25:
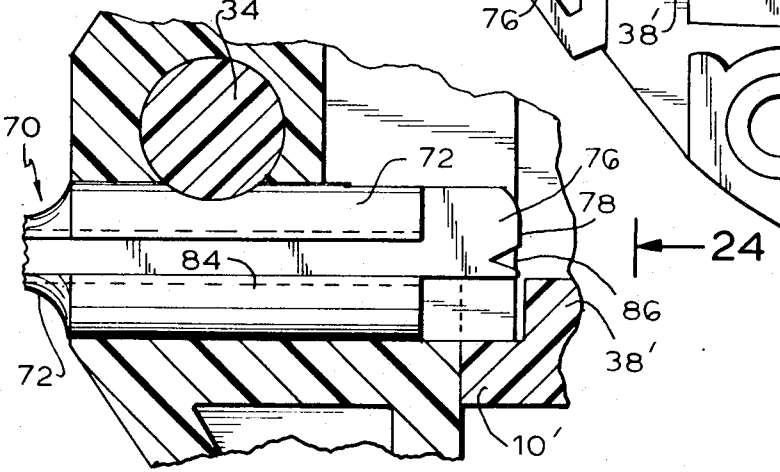
FIG. 25 is an enlarged fragmentary view of the needle receiving portion of the tag attaching apparatus illustrated in FIG. 23, showing the needle of the present invention.
Figure 33:
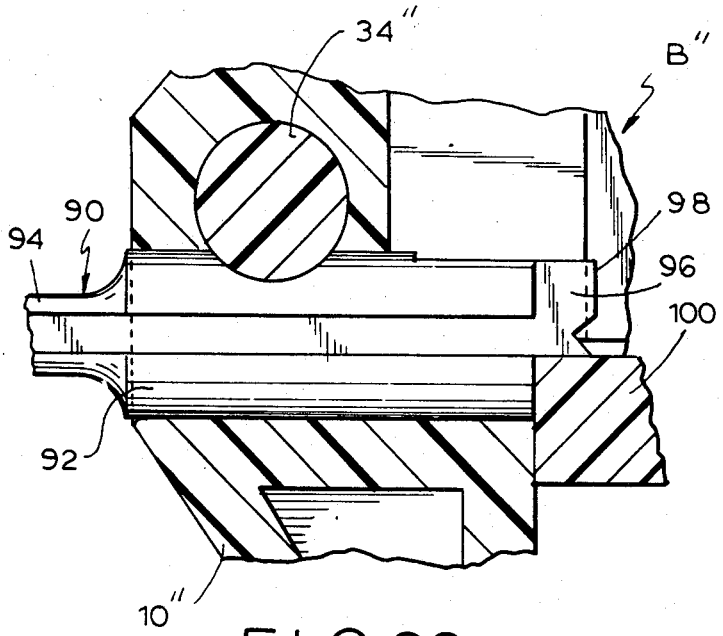
FIG. 33 is a view similar to that of FIG. 30 showing the needle of the present invention mounted in the apparatus.
Figure 32:
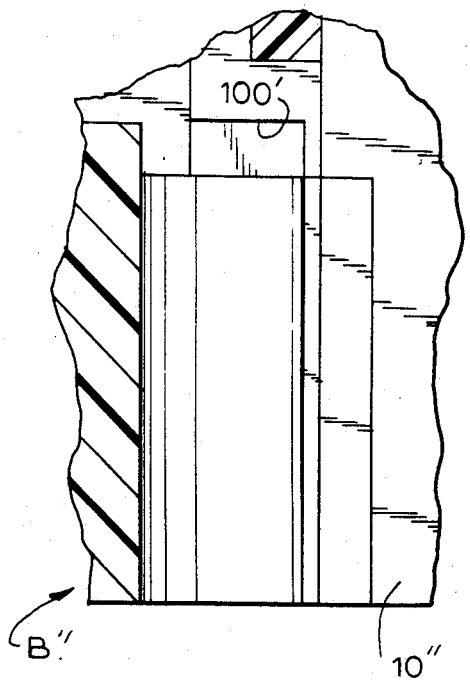
FIG. 32 is a view taken along line 32—32 of FIG. 31.
Figure 30:
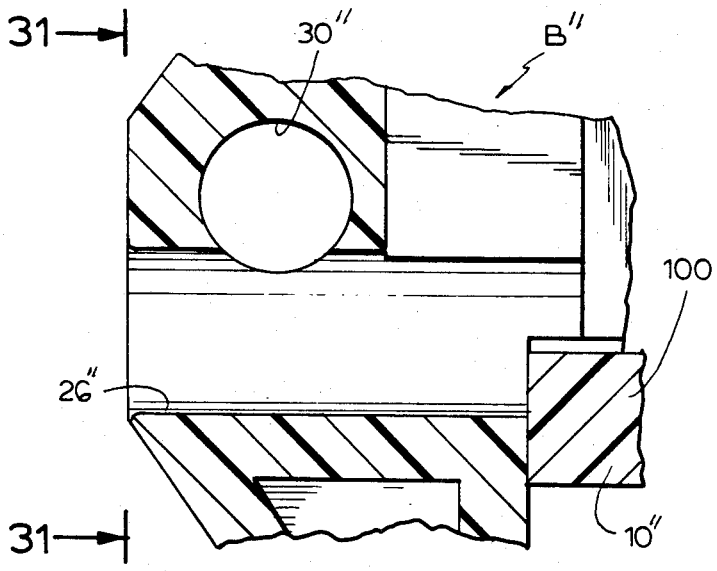
FIG. 30 is an enlarged fragmentary view of the needle receiving portion of a modification of the tag attaching apparatus illustrated in FIGS. 14–29.

FIGS. 23–25 show that the needle of the present invention also is adapted to fit within the needle receiving opening 26′ of body A′. In particular, FIG. 25 shows that the rearwardly extending knife part 76 fits easily within the space forward of shoulder 38′ with the blade 76 situated in the proper position, tangential to the bore of the needle. The "V"-shaped notch 86, situated along bisecting plane 82, functions to properly position the connecting part 24 with the knife part 76 such that a severance is obtained without any substantial portion of the connecting part 24 remaining attached to T-bar end 16.

Accordingly, it is clear that the needle assembly of the present invention can be used in tag attaching apparatus of the type designed to receive a knifeless needle and separate cutting blade, and attacher apparatus designed to receive a needle with a knife blade mounted within the confines of the base. The needle of the present invention is "universal" in the sense that it can be used in either of the leading types of tag attaching apparatus commercially available today.

FIGS. 30–33 illustrate a modified version of the tag attaching apparatus illustrated in FIGS. 14–29. The modified apparatus is the same in every respect as that shown in FIGS. 14–29, except for the configuration of shoulder 100. Accordingly, all numbers on the drawings are provided with a double prime (″) to indicate corresponding parts in the previously discussed attachers.

Figure 31:
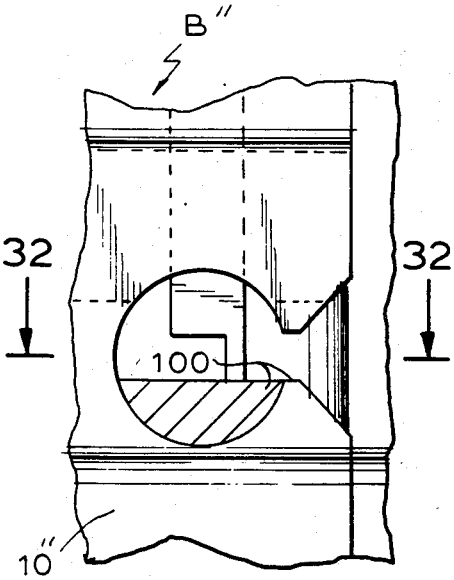
FIG. 31 is a view taken along line 31—31 of FIG. 30.

Shoulder 100, as can best be seen in FIG. 31, has now been widened such that it now extends entirely across the rear of opening 26″. The reason for this modification can best be appreciated by a comparison of FIGS. 25 and 33 which show the needle assembly of the present invention as received in the conventional attacher and modified attacher, respectively.

In FIG. 25, there is a rectangular space situated forward of shoulder 38′ beneath blade 76. If the plunger which pushes the T-bar end of the attachment against the blade and then through the needle bore is slightly misaligned (which is common in this type of apparatus) a portion of the attachment may be forced into the space forward of shoulder 38′ and cause the attacher to jam.

By extending shoulder 38′ to form shoulder 100, this problem is eliminated. The extended shoulder occupies the space which was formerly present and acts to guide the attachment into the proper position as it is moved by the plunger.

This modification also has an additional advantage. It will permit only the needle assembly of the present invention to be used. Neither the knifeless needle, my patented needle, nor the needle with the blade mounted within the confines of the base will fit the modified attacher.

While only a single preferred embodiment of the present invention has been disclosed herein for purposes of illustration, it is obvious that many variations and modifications could be made thereto. It is intended to cover all of these variations and modifications which fall within the scope of the present invention, as defined by the following claims.

I claim:

1. A needle assembly for use fastener attaching apparatus comprising a substantially cylindrical base having a side surface, a central bore, and a slot defined by an edge, the plane bisecting said base passing through said slot, a needle part extending from one end of said base and a knife part extending from and beyond the other end of said base, said knife part comprising a substantially planar body situated substantially tangentially to said bore and extending from a point proximate said side surface of said base, through said plane, to a point substantially aligned with said edge of said slot.

2. The assembly of claim 1, wherein said body comprises a cutting blade.

3. The assembly of claim 2, wherein said blade comprises a "V"-shaped notch aligned with said plane.

4. Fastener attaching apparatus comprising a housing including a needle assembly receiving opening, a shoulder protruding into alignment with and partially obstructing one end of the opening, a needle assembly comprising a substantially cylindrical base adapted to be received in the opening having a side surface, a central bore and a slot defined by an edge, the plane bisecting said base passing through said slot, a needle part extending from one end of said base, a knife part extending from and beyond the other end of said base, said knife part comprising a substantially planar body situated substantially tangentially to said bore and extending from a point proximate the side surface of said base, through said plane, to a point spaced from said plane by a distance approximately equal to the distance between said plane and a parallel plane which intersects the edge of said base slot, such that said body is received proximate said shoulder.

5. The apparatus of claim 4, wherein said body part comprises a cutting blade.

6. The apparatus of claim 5, wherein said blade comprises a "V"-shaped notch aligned with said plane.

7. The apparatus of claim 4, wherein said housing further comprises means for removably mounting a cutting blade in alignment with the end of said opening, proximate said shoulder.

* * * * *